US008305325B2

(12) United States Patent
Kawasaki et al.

(10) Patent No.: US 8,305,325 B2
(45) Date of Patent: Nov. 6, 2012

(54) COLOR DISPLAY APPARATUS AND ACTIVE MATRIX APPARATUS

(75) Inventors: Somei Kawasaki, Saitama (JP); Masami Iseki, Yokohama (JP); Fujio Kawano, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 941 days.

(21) Appl. No.: 12/063,306

(22) PCT Filed: Mar. 30, 2007

(86) PCT No.: PCT/JP2007/057690

§ 371 (c)(1),
(2), (4) Date: Feb. 8, 2008

(87) PCT Pub. No.: WO2007/114500

PCT Pub. Date: Oct. 11, 2007

(65) Prior Publication Data

US 2009/0102853 A1 Apr. 23, 2009

(30) Foreign Application Priority Data

Mar. 31, 2006 (JP) ..... 2006-097998

(51) Int. Cl.
*G09G 3/36* (2006.01)

(52) U.S. Cl. ..... 345/100

(58) Field of Classification Search ..... 345/100
See application file for complete search history.

(56) References Cited

U.S. PATENT DOCUMENTS

| | | | | |
|---|---|---|---|---|
| 5,933,033 | A | 8/1999 | Shima | |
| 6,559,836 | B1 | 5/2003 | Mori | |
| 7,126,565 | B2 | 10/2006 | Kawasaki et al. | |
| 7,242,397 | B2 | 7/2007 | Iseki et al. | 345/204 |
| 7,675,486 | B2 | 3/2010 | Takai | |
| 2003/0011584 | A1 | 1/2003 | Azami et al. | |
| 2004/0008074 | A1 | 1/2004 | Takehara et al. | |
| 2004/0041764 | A1 * | 3/2004 | Koyama et al. | 345/87 |
| 2004/0104909 | A1 | 6/2004 | Kawasaki et al. | |
| 2004/0183752 | A1 | 9/2004 | Kawasaki et al. | |

(Continued)

FOREIGN PATENT DOCUMENTS

| | | | |
|---|---|---|---|
| JP | 09-152850 | A | 6/1997 |

(Continued)

*Primary Examiner* — Quan-Zhen Wang
*Assistant Examiner* — Nelson D Runkle, III
(74) *Attorney, Agent, or Firm* — Fitzpatrick, Cella, Harper & Scinto

(57) ABSTRACT

A color display apparatus includes a display unit having electro-optical elements arranged in a row direction and a column direction, scanning lines provided in respective rows of the electro-optical elements to select respective rows, and data lines provided in respective columns and supplying data signals to electro-optical elements in the row which the scanning lines select, and conversion circuits each of which receives a digital video signal and converts the digital video signal to an analog video signal. In addition, a first dispersion circuit receives the analog video signals outputted from the conversion circuits and exchanges an arrangement of the analog video signals to output to bus lines, column drive circuits sample the analog video signals in the bus lines in a time sharing manner and generate and output the data signals, and a second dispersion circuit receives the data signals outputted from the column drive circuits and rearranges the data signals to output to the data lines. The rearranging of the data signals by the second dispersion circuit restores the exchanging of the arrangement by the first dispersion circuit.

6 Claims, 8 Drawing Sheets

U.S. PATENT DOCUMENTS

| | | | | |
|---|---|---|---|---|
| 2005/0078079 | A1* | 4/2005 | Hashimoto | 345/100 |
| 2005/0122150 | A1 | 6/2005 | Iseki et al. | 327/215 |
| 2005/0140608 | A1 | 6/2005 | Takai | |
| 2005/0185098 | A1 | 8/2005 | Pencil et al. | |
| 2005/0285151 | A1 | 12/2005 | Kawasaki | 257/213 |
| 2006/0114194 | A1 | 6/2006 | Kawasaki et al. | 345/76 |
| 2006/0114195 | A1 | 6/2006 | Yamashita et al. | 345/76 |
| 2006/0132395 | A1 | 6/2006 | Kawasaki et al. | 345/75.2 |
| 2007/0132719 | A1 | 6/2007 | Yamashita et al. | 345/156 |

FOREIGN PATENT DOCUMENTS

| | | | |
|---|---|---|---|
| JP | 2001-242839 | A | 9/2001 |
| JP | 2005-164666 | A | 6/2005 |
| JP | 2005-301007 | A | 10/2005 |

* cited by examiner

FIG. 8

| | COLUMN R | COLUMN G | COLUMN B |
|---|---|---|---|
| (1) | $A1 \times k^2$ | $A2 \times k^2$ | $A3 \times k^2$ |
| (2) | $B2 \times k^2$ | $B3 \times k^2$ | $B1 \times k^2$ |
| (3) | $A3 \times k^2$ | $A1 \times k^2$ | $A2 \times k^2$ |
| (1) | $B1 \times k^2$ | $B2 \times k^2$ | $B3 \times k^2$ |
| (2) | $A2 \times k^2$ | $A3 \times k^2$ | $A1 \times k^2$ |
| (3) | $B3 \times k^2$ | $B1 \times k^2$ | $B2 \times k^2$ |

FIG. 9

| | COLUMN R | COLUMN G | COLUMN B |
|---|---|---|---|
| (1) | $A1 \times k1^2$ | $A2 \times k2^2$ | $A3 \times k3^2$ |
| (2) | $B2 \times k2^2$ | $B3 \times k3^2$ | $B1 \times k1^2$ |
| (3) | $A3 \times k3^2$ | $A1 \times k1^2$ | $A2 \times k2^2$ |
| (1) | $B1 \times k1^2$ | $B2 \times k2^2$ | $B3 \times k3^2$ |
| (2) | $A2 \times k2^2$ | $A3 \times k3^2$ | $A1 \times k1^2$ |
| (3) | $B3 \times k3^2$ | $B1 \times k1^2$ | $B2 \times k2^2$ |

FIG. 10

| | COLUMN R | COLUMN G | COLUMN B |
|---|---|---|---|
| (1) | $A1 \times k1^2$ | $A2 \times k2^2$ | $A3 \times k3^2$ |
| (2) | $B2 \times k1^2$ | $B3 \times k2^2$ | $B1 \times k3^2$ |
| (3) | $A3 \times k1^2$ | $A1 \times k2^2$ | $A2 \times k3^2$ |
| (1) | $B1 \times k1^2$ | $B2 \times k2^2$ | $B3 \times k3^2$ |
| (2) | $A2 \times k1^2$ | $A3 \times k2^2$ | $A1 \times k3^2$ |
| (3) | $B3 \times k1^2$ | $B1 \times k2^2$ | $B2 \times k3^2$ |

COLOR DISPLAY APPARATUS AND ACTIVE MATRIX APPARATUS

TECHNICAL FIELD

The present invention relates to a display apparatus and an active matrix apparatus which arrange pixels or pixel circuits which have electro-optical elements in a matrix.

BACKGROUND ART

Recently, display units and the like which use electro-optical elements attract attention as next-generation display units. Here, an organic electroluminescence (EL) element which is a current control type light emitting element in which emission luminance is controlled by a current which flows into the element will be cited as an example, and will be described.

In an organic EL display apparatus including a peripheral circuit, thin-film transistors (TFTs) are used not only in a display region but also in the peripheral circuit. Image display panels which use EL elements which are such self-emission type optical elements for image display elements, and which use TFTs in a display region and a peripheral circuit are known by U.S. Pat. No. 7,126,565 and U.S. Patent Laid-Open No. 2004-0183752.

Video signals input into the above-mentioned image display panels are analog video signals into which digital color video signals of three colors of red (R), green (G), and blue (B) are converted by digital-to-analog converters (DACs). Alternatively, after converting a digital luminance signal and digital color difference signals into digital color video signals in three colors of RGB, they are analog video signals converted by digital-to-analog converters (DACs).

In this case, although three DACs are needed, and the DACs are made into an integrated circuit using single-crystal silicon, the three DACs have characteristic dispersion.

The present inventor found out that there was a possibility that this characteristic dispersion among DACs might have display non-uniformity of a pattern fixed in a display panel, and might be visualized.

An object of the present invention is to provide a color display apparatus and an active matrix apparatus which can decrease the display non-uniformity by the characteristic dispersion of DACs.

DISCLOSURE OF THE INVENTION

The gist of the present invention is a color display apparatus comprising:

a display unit comprising electro-optical elements which are arranged in a matrix in a row direction and a column direction and classified by color of emitted light, scanning lines which are provided in respective rows of the electro-optical elements arranged in a matrix, and select respective rows in a time sharing manner, and data lines which are equally provided in respective columns and supply data signals to electro-optical elements in the rows which the scanning lines select;

conversion circuits into which video signals for each color which classify the electro-optical elements are input, and convert and output the input video signals to other video signals;

a first dispersion circuit for changing sequence of the converted video signals outputted from the conversion circuits, and for outputting the converted video signals to the same number of bus lines;

column drive circuits which sample the signals in the bus lines in the time sharing manner, and generate and output the data signals; and a second dispersion circuit for returning the sequence of the converted video signals changed by the first dispersion circuit into an original sequence, in relation to the outputs of the column drive circuits, and for outputting to the data lines the converted video signals of which sequence is returned.

The second gist of the present invention is an active matrix apparatus which has a matrix unit in which a plurality of pixel circuits is arranged in a matrix, a plurality of data lines connected to the matrix unit commonly every column, and a plurality of column drive circuits which is provided to correspond with columns of the matrix unit, and which outputs data signals supplied to the pixel circuits for every row, to the plurality of data lines, characterized by having:

a first dispersion circuit for selecting the column drive circuits used as output destinations of analog video signals for each color obtained by DA converting digital video signals for every color;

a second dispersion circuit for selecting the data lines used as output destinations of the data signals from the column drive circuits; and control lines which control the first and second dispersion circuits so as to sequentially change the drive circuits used as output destinations of the analog video signals for each color, and the data lines used as output destinations of the data signals, for every scanning period.

The present invention has such construction of supplying outputs to pixels or pixel circuits with sequentially changing data lines of output destinations of column drive circuits. In this way, it can be performed to average temporally dispersion of values of currents supplied to pixels or pixel circuits, and in other words, to disperse them spatially. Therefore, it can be performed to reduce non-uniformity of a display image such as a vertical line, which appears on a screen, visually. In addition, it can be performed to reduce visually the non-uniformity of a display image with a fixed pattern each predetermined row caused by the characteristic dispersion among DACs, by the dispersion circuit which changes output destinations from the DACs. Further features of the present invention will become apparent from the following description of exemplary embodiments with reference to the attached drawings.

BRIEF DESCRIPTION OF THE DRAWINGS

FIG. 8 is a schematic diagram for explaining a voltage-current conversion factor in each pixel.

FIG. 9 is a schematic diagram for explaining a voltage-current conversion factor in each pixel according to the comparative example.

FIG. 10 is a schematic diagram for explaining a voltage-current conversion factor in each pixel according to an embodiment of the present invention.

BEST MODES FOR CARRYING OUT THE INVENTION

Figure 1:
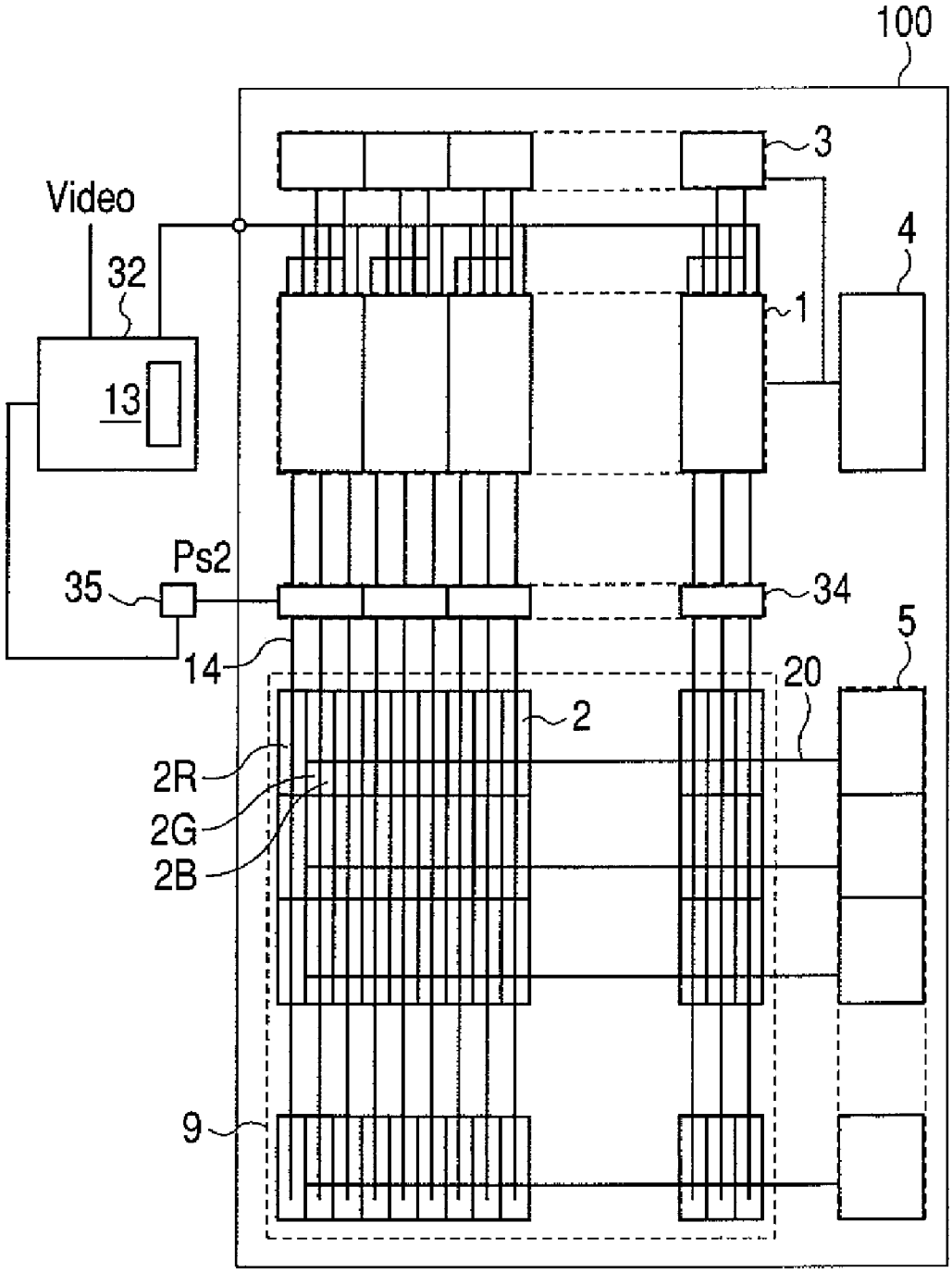
FIG. 1 is a block diagram illustrating construction of a display apparatus according to one embodiment of the present invention.

FIG. 1 is a schematic diagram showing construction of a display apparatus according to a first embodiment of the present invention. The display apparatus illustrated in FIG. 1 has a display panel 100. On a common substrate of the display panel 100, the RGB primary color number of EL elements, and pixel circuits 2 constructed of TFTs for controlling currents input into these EL elements are stacked. EL elements are classified by the color of emitted light, and they are classified into three of RGB in this embodiment. Pixels or pixel circuits (2R, 2G, 2B) for each color construct a color display unit (matrix unit) 9 where they are arranged in a matrix of 3N columns by M rows in a column direction and a row direction respectively, and are integrated on the common substrate with the peripheral circuit.

Reference numeral 14 denotes a plurality (3N lines) of data lines which is connected to the pixel circuits 2 commonly for every column and is provided, reference numeral 20 denotes a plurality (M lines) of row selection lines provided for every row. The peripheral circuit is equipped with column drive circuits 1, column shift registers 3, row shift registers 5, a gate circuit 4, and second dispersion circuits 34. Digital video data Video is processed by a signal processing circuit 32, and is supplied to DACs in the signal processing circuit. Analog video signals for each color from DACs are input into column drive circuits 1 through a first dispersion circuit 13 in this signal processing circuit.

Each transistor in each circuit of the display panel 100 is constructed of a TFT which has an active layer of a non-monocrystalline semiconductor, such as a polysilicon. In addition, each transistor in the signal processing circuit 32 and a control circuit 35 is constructed of a transistor whose active layer is a monocrystalline semiconductor, such as single-crystal silicon.

The control circuit 35 may be integrated in the signal processing circuit 32.

(Pixel Circuit)

Figure 2:
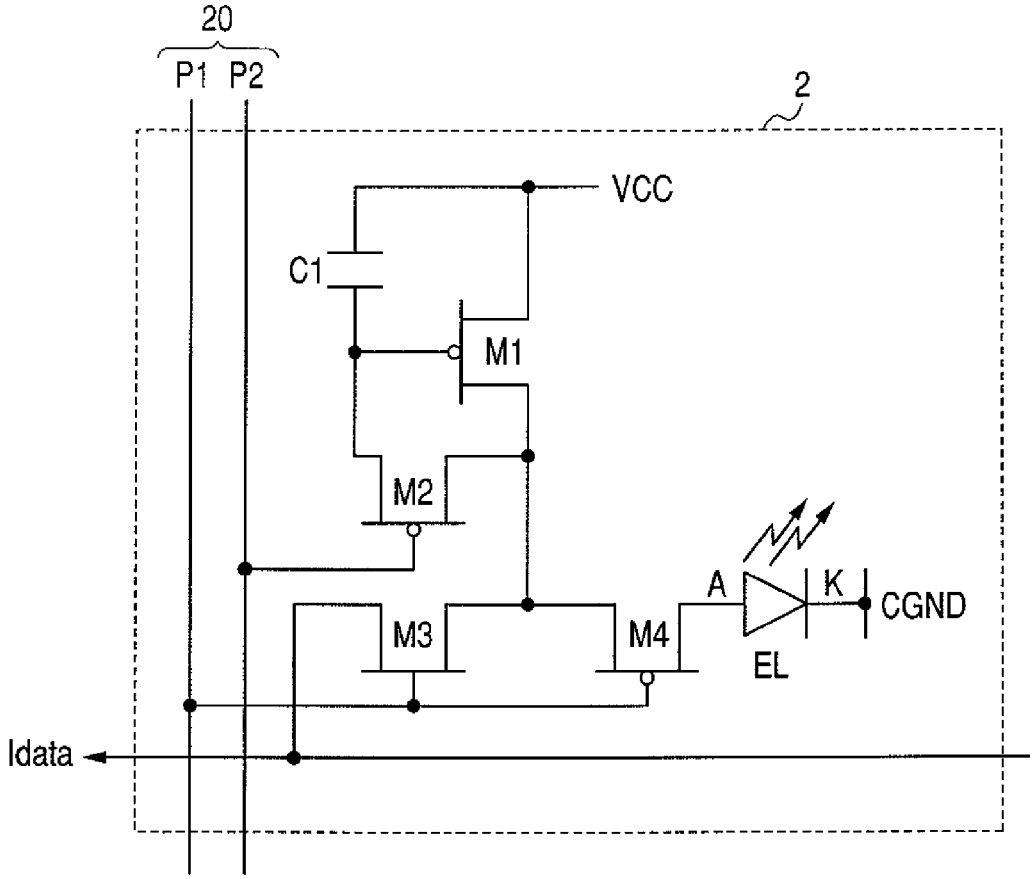
FIG. 2 is a circuit diagram of a pixel circuit used in the present invention.

FIG. 2 illustrates a construction example of a pixel circuit 2 including an EL element as an electro-optical element used in the present invention. In fact, each of the row selection lines 20 illustrated in FIG. 1 is constructed of two scanning lines. As the electro-optical element used in the present invention, anything is usable so long as it can change optical characteristics, such as emission, transmission, and reflection of light, by electric means, such as a voltage application and current supply. A liquid crystal element, an organic or inorganic EL element, an element into which an electron-emitting source and a phosphor are combined, a light-emitting diode, and the like are cited.

In FIG. 2, reference numerals P1 and P2 denote scan signals, and a current data Idata is input as a data signal. An anode of an EL element is connected to a drain terminal of a TFT (M4), and a cathode is connected to the earth potential CGND. Reference numerals M1, M2, and M4 denote P-type TFTs, and reference numeral M3 denotes an N-type TFT.

Figure 3:
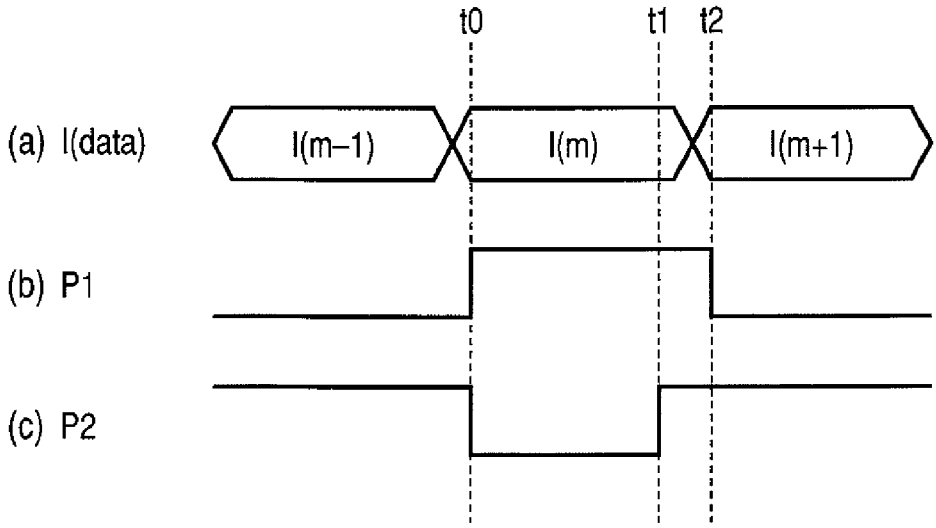
FIG. 3 is a timing chart for explaining an operation of the pixel circuit illustrated in FIG. 2.
Figure 4:
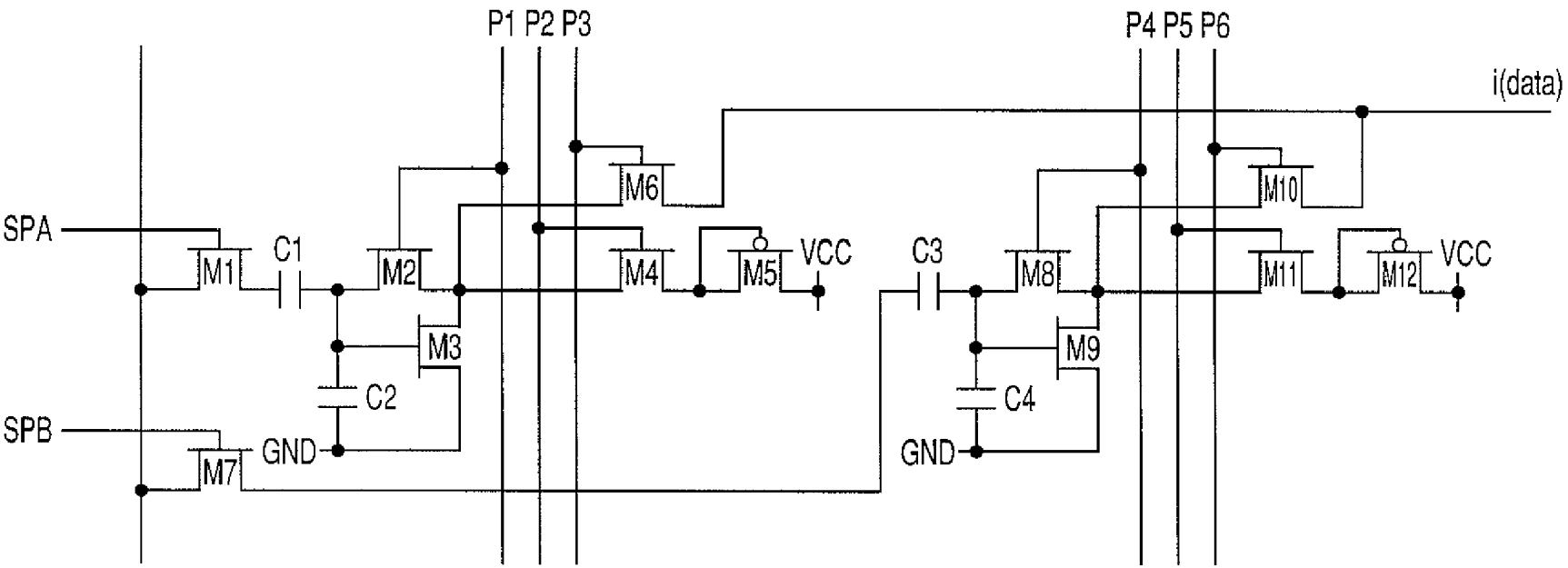
FIG. 4 is a circuit diagram of a column drive circuit used in the present invention.

FIG. 3 is a timing chart for explaining a drive method of the pixel circuit 2. In FIG. 4, I(m−1), I(m), and I(m+1) denote the current data Idata input into the pixel circuit 2 of a (m−1)-th row (one-previous row), an m-th row (target row), and a (m+1)-th row (one-following row).

First, at the time before time t0, a signal in a Low level is input into the scan signal P1 in the pixel circuits 2 of the object row and a signal in a High level is input into P2, and a transistor M2 is OFF, M3 is OFF, and M4 is ON. In these states, I (m−1) corresponding to the one-previous row of current data Idata is not input into the pixel circuits 2 of the m-th row which is the target row.

Subsequently, at time t0, a signal in a High level is input into P1 and a signal in a Low level is input into P2, and, transistors M2 and M3 become ON, and M4 becomes OFF. In these states, I(m) corresponding to the target row of current data Idata is input into the pixel circuits 2 of the m-th row which is the target row. Since M4 is not conductive at this time, a current does not flow in an EL element. A voltage according to the current driving capability of M1 occurs in a capacity C1, which is arranged between a gate terminal of M1, and a power supply potential VCC, by the input Idata. Thus, current-voltage conversion is once performed in the pixel circuit.

In the above explanation, although an active matrix display apparatus is cited and explained as an example, as a display unit (matrix unit) used in the present invention, a passive matrix where electro-optical elements are arranged at intersections of a plurality of data lines and a plurality of row selection lines may be used.

(Column Drive Circuit)

A column drive circuit used in the present invention is illustrated in FIG. 4.

This circuit is the same as the column drive circuit described in U.S. Pat. No. 7,126,565. Refer to the above-mentioned document for detailed explanation.

This drive circuit is constructed of a pair of voltage-current conversion circuits, and explains their main operations. A switching transistor M6 is turned off, a switching transistor M10 is turned on, and a drain current of a voltage-current converting transistor M9 is output to an output line idata. At this time, a switching transistor M1 turns on by a sampling signal SPA, and an analog video signal voltage VIDEO is stored as a gate voltage of another voltage-current converting transistor M3. Thereby, the transistor M3 becomes in a state that a predetermined drain current can be flowed.

Next, the switching transistor M6 turns on, the switching transistor M10 turns off, and a drain current of the transistor M3 is output to the output line idata. At this time, a switching transistor M7 turns on by the sampling signal SPA again, and the analog video signal voltage VIDEO which is taken in is stored as a gate voltage of the transistor M9. Thereby, the transistor M9 becomes in a state that a drain current can be flowed.

The above two operations are repeated each row scanning period, and an analog signal current is output to the output line idata one by one. Let a write voltage V of a gate of the transistor M3 and a gate of the transistor M9 by effective amplitude of the analog video signal voltage VIDEO, and drive factors β of the transistors M3 and M9 be A and B, respectively.

A drain current i(M3) of the transistor M3 and a drain current i(M9) of the transistor M9 fulfill the following relations.

$$i(M3)=A\times V^2$$

$$i(M9)=B\times V^2$$

A drive factor of each voltage current conversion circuit is determined by a capacitance split ratio of capacitors C1 (or C3) and C2 (or C4). In addition, at the same time, it is also determined by a gate width to a gate length (W/L) of the voltage-current converting transistor M3 (or M9).

Although a TFT in which a non-monocrystalline semiconductor used in each transistor is used in an active layer has large characteristic dispersion, it is not fundamentally affected by fluctuation of a threshold voltage Vth of the transistor M3 and transistor M6 of each column in the circuit construction of FIG. 4. Although it is affected by fluctuation of the drive factor β of the transistors M3 and M6 of each row, influence can be reduced by enlarging size of the transistors M3 and M9. However, the residual influence by the fluctuation of the drive factor β becomes dispersion in a data signal current of each column, and a display non-uniformity such as a "vertical line" is visually recognized in a display image in an EL element that display luminance is determined by a current amount of the data signal.

Figure 5:
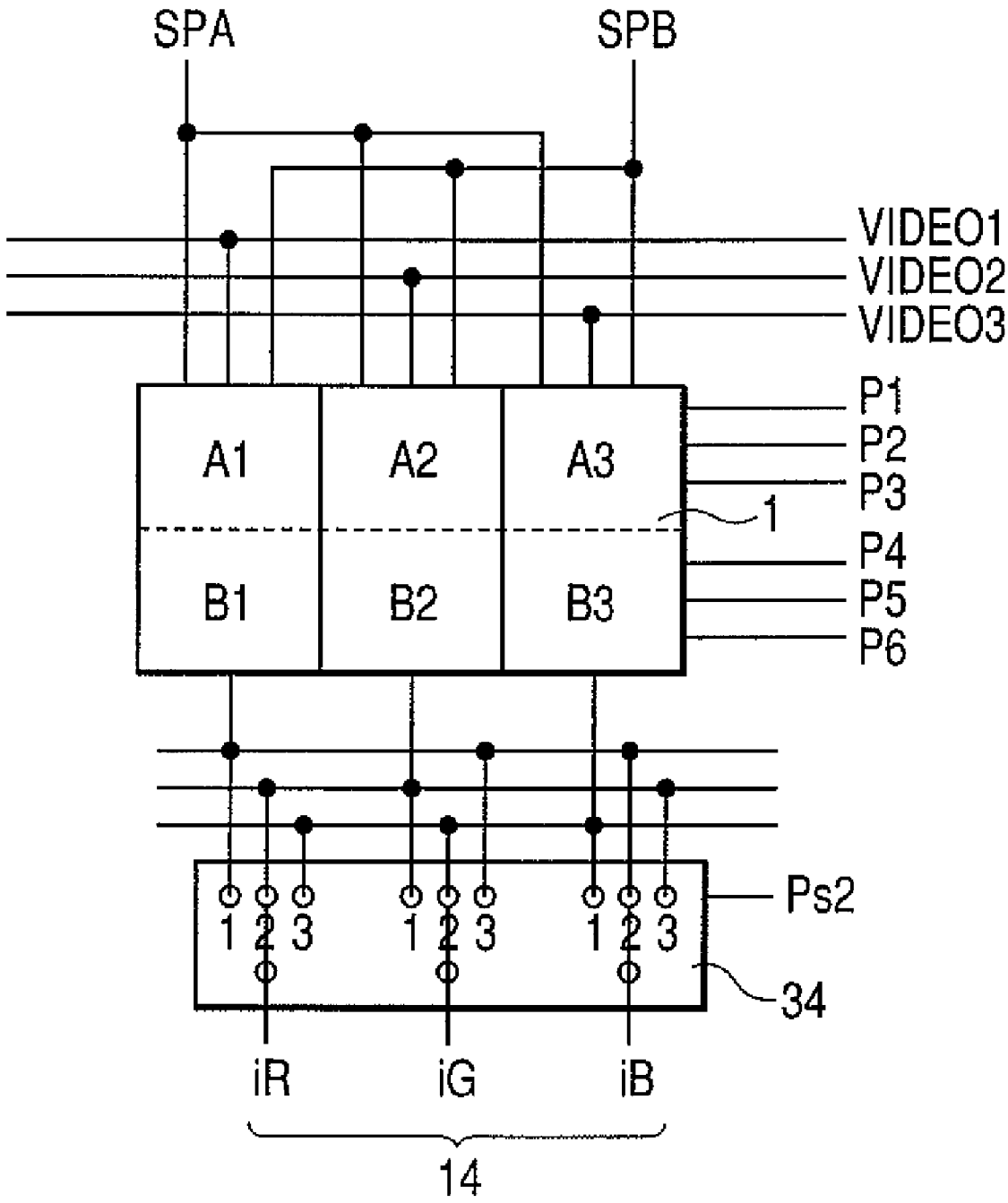
FIG. 5 is a schematic diagram for explaining a peripheral circuit including the column drive circuits and a second dispersion circuit according to the first embodiment of the present invention.

FIG. 5 illustrates construction of a column drive circuit 3, including a function for reducing the "vertical line" which appears in a display image, and a second dispersion circuit.

FIG. 5 corresponds to a color display apparatus and illustrates three-column construction corresponding to RGB 3. Sampling signals SPA and SPB are input into a column current generation circuit 1.

An analog video signal voltage VIDEO1 input is input into a voltage-current conversion circuit (a pair of voltage-current conversion circuits same as that in FIG. 4 mentioned above) with drive factors A1 and B1. An analog video signal voltage VIDEO2 input is input into a voltage-current conversion circuit (a pair of voltage-current conversion circuits same as that in FIG. 4 mentioned above) with drive factors A2 and B2. An analog video signal voltage VIDEO3 input is input into a voltage-current conversion circuit (a pair of voltage-current conversion circuits same as that in FIG. 4 mentioned above) with drive factors A3 and B3.

Three output lines of three column drive circuits 1 are input into a distributing switch unit (second dispersion circuit) 34 including three three-input/one-output switches, and are output to an R column, a G column, and a B column, to which they correspond respectively, as data signal currents iR, iG, and iB.

A distributing switch unit 34 changeably selects a data line 14 which becomes an output destination of a data signal from the column drive circuit. Although original video signals are exchanged by the first dispersion circuit mentioned later and are output to bus lines, the second dispersion circuit restores this exchange.

A control signal supplied to a control line Ps2 from the control circuit 35 can determine changeably a connection state of the distributing switch unit 34.

Then, three switches of the distributing switch unit 34 are controlled by the control signal supplied to the control line Ps2 so that they may interlock.

Figure 6:
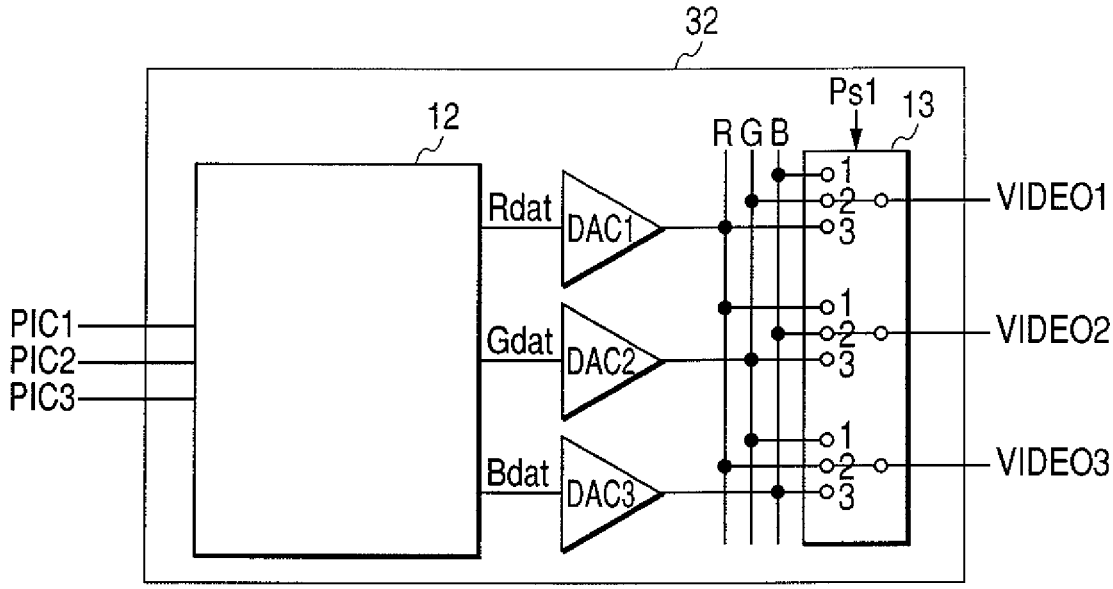
FIG. 6 is a block diagram for explaining a signal processing circuit including a first dispersion circuit according to the first embodiment of the present invention.

FIG. 6 illustrates the signal processing circuit 32 used in the present invention. Reference numeral 12 in FIG. 6 is a DSP (digital signal processor) which performs digital signal processing which converts digital video data PIC1, PIC2, and PIC3, which are input, into digital video signals for display in the display panel 100. The digital video signals which correspond to pixel construction of the display panel and are output from the DSP 12 are constructed of a red digital video signal Rdat, a green digital video signal Gdat, and a blue digital video signal Bdat.

These digital video signals for respective colors are converted into analog video signals for respective colors by digital-to-analog converters DAC1, DAC2, and DAC3, respectively, and are input into the distributing switch unit 13, which is the first dispersion circuit, through a matrix wiring unit.

In the distributing switch unit 13, the analog video signal lines VIDEO1, VIDEO2, and VIDEO3, which are output destinations of respective DACs, are suitably selected by the control signal input into a control line Ps1. That is, the distributing switch unit 13 which constructs the first dispersion circuit exchanges three RGB lines of video signals input from the external, and outputs them to the bus lines (analog video signal line).

The control signal supplied to the control line Ps1 is generated in a control circuit which is not illustrated and is integrated inside the signal processing circuit 32. The control signal in the control line Ps1 can determine a connection state of the first dispersion circuit 13, that is, which of the analog video signal line VIDEO1, VIDEO2, and VIDEO3 becomes an output destination of a DAC. Then, this connection state can be changed.

Then, the first dispersion circuit 13 and the second dispersion circuit 34 are controlled by the control circuit 32 and the control circuit 35 so as to select a suitable connection state, mentioned later, with collaborating.

In the above explanation, a digital video signal for each color is converted into an analog video signal by a D/A-converter. When an original input video signal is analog, an analog amplifier or the like is used instead of a D/A-converter. What is necessary is that it is a circuit for driving bus lines with large capacity, such as a D/A-converter, or an analog amplifier.

Comparative Example

Here, in order to make the operations and effects by the embodiments of the present invention easy to understand, a comparative example will be explained first.

Figure 7:
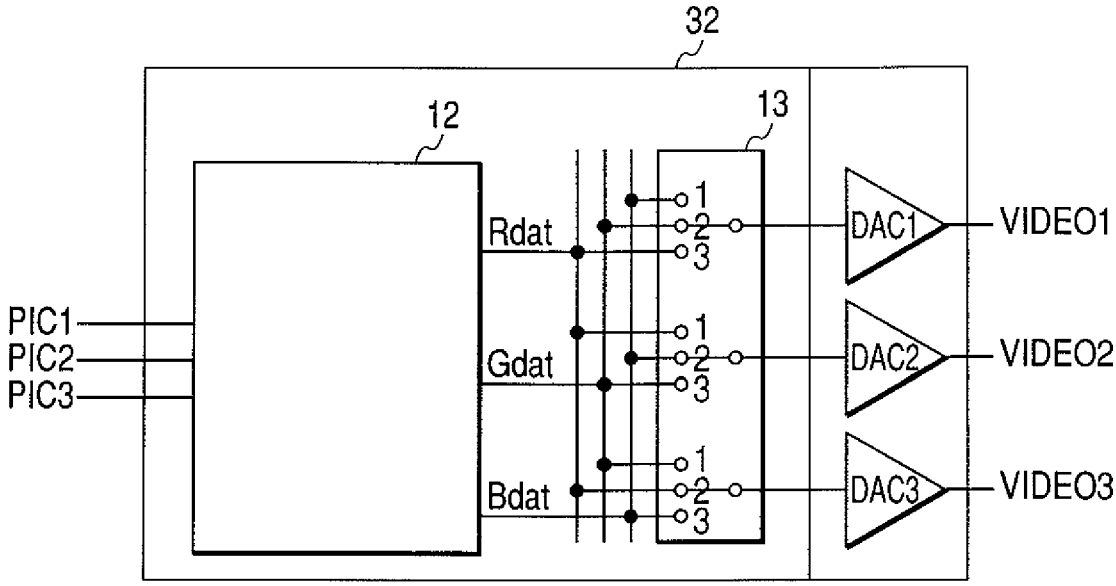
FIG. 7 (Prior Art)
FIG. 7 is a block diagram for explaining a signal processing circuit including a first dispersion circuit according to a comparative example.

A case that the construction illustrated in FIG. 5 is adopted as a column drive circuit and a dispersion circuit, and the construction illustrated in FIG. 7 is adopted as a signal processing circuit will be explained. FIG. 7 illustrates an example of a signal processing circuit. This circuit is constructed of an LSI which is constructed of an integrated circuit of transistors of using single-crystal silicon.

Digital video data PIC1, PIC2, and PIC3 which are input are input into the DSP 12. The digital video data PIC1, PIC2, and PIC3 may be RGB data or YUV data. The DSP 12 which performs video signal processing outputs digital video signals Rdat, Gdat, and Bdat for each color corresponding to a display apparatus from the digital video data PIC1, PIC2, and PIC3.

For that purpose, the DSP 12 performs color space transformation (unnecessary when digital video signals input are RGB data) if needed. At least one kind of processing selected from resolution conversion, edge enhancement, noise reduction, gamma correction, white balance, black setting, luminance setting, and the like other than this is performed by digital signal processing in the DSP 12.

The digital video signals Rdat, Gdat, and Bdat for each color are input into the DAC1, DAC2, and DAC3 with a gain k through the distributing switch unit 13, respectively. Then, they are converted into the analog video signals VIDEO1, VIDEO2, and VIDEO3 by the DAC1, DAC2, and DAC3 and are output.

A generating operation of signal currents for corresponding to displaying respective RGB which is performed from the column drive circuit in FIG. 5 and the display apparatus control circuit in FIG. 7 will be explained.

Each color data input into each DAC by the distributing switch unit 13 in FIG. 7 is illustrated in the following Table 1. States (1) to (3) correspond to three connection states of the distributing switch unit 13.

TABLE 1

| State | DAC1 input | DAC2 input | DAC3 input |
|---|---|---|---|
| (1) | Bdat | Rdat | Gdat |
| (2) | Gdat | Bdat | Rdat |
| (3) | Rdat | Gdat | Bdat |

On the other hand, the drive factors of the column drive circuit selected by the distributing switch unit 34 in FIG. 5 is illustrated. Here, in the column drive circuit illustrated in FIG. 4, an analog video signal is sampled in a previous horizontal scanning period, and a data signal current into which the analog video signal having been previously sampled is voltage-current converted in the next horizontal scanning period is supplied. Therefore, when making the state of the distributing switch unit 13 correspond to the following table 2, it becomes in the order of (3), (1), (2), (3), (1), and (2) from a top.

TABLE 2

| State | R column current | G column current | B column current |
|---|---|---|---|
| (1) | A1 | A2 | A3 |
| (2) | B2 | B3 | B1 |
| (3) | A3 | A1 | A2 |
| (1) | B1 | B2 | B3 |
| (2) | A2 | A3 | A1 |
| (3) | B3 | B1 | B2 |

As mentioned above, since a current output from the column drive circuit in FIG. 4 is determined by an analog video signal input before one horizontal scanning period, as is evident from Tables 1 and 2, signal currents of desired colors are supplied to the data lines of RGB columns in all the selected states of the distributing switch units 34 and 13.

FIG. 8 is a table showing the voltage-current conversion factor corresponding to each pixel according to the voltage-current conversion characteristics expressed in Formulas 1 and 2 of the column drive circuit.

The figures in the left end of FIG. 8 are the connection states of the distributing switch units 34 and 13, and repeat "(1)→(2)→(3)" in each row. A data signal current of each column is output by switching the voltage-current conversion circuits of the drive factors A1, B2, A3, B1, A2, and B3 in the column drive circuit 1 one by one. Therefore, since it is dispersed in a cycle of six lines even if dispersion exists among the drive factors A1, B2, A3, B1, A2, and B3 as illustrated in FIG. 8, the "vertical line" of a display image is reduced ocularly.

Nevertheless, there is dispersion among respective gains of digital-to-analog converters DAC1, DAC2, and DAC3 in FIG. 7. This is based on the characteristics dispersion among transistors or built-in resistors which is generated at the time of LSI production. All the gains of digital-to-analog converters DAC1, DAC2, and DAC3 are not the same, and have respectively values k1, k2, and k3 of the gains which are mutually different.

FIG. 9 is a table showing the voltage-current conversion factor corresponding to each pixel according to the voltage-current conversion characteristics expressed in Formulas 1 and 2 of the column drive circuit in this case.

As is evident from FIG. 9, a current of each pixel fluctuates in a cycle of three lines owing to the gain dispersion among the DAC1, DAC2, and DAC3. In addition, the gain dispersion is emphasized in square-law characteristics. For this reason, the display non-uniformity of a repeated fixed pattern in every three lines is generated throughout a display image. The square effect of this gain dispersion is one cause of the display non-uniformity which the present inventor found out.

Embodiment 1

One embodiment of the present invention uses construction illustrated in FIG. 6 as the signal processing circuit 32 in the color display apparatus in FIG. 1. A point that the construction in FIG. 6 is fundamentally different from the construction illustrated in FIG. 7 is that positions of the distributing switch unit 13 which is a first dispersion circuit, and DACs are reverse to a flow of video signals.

Color signals output to video signal outputs VIDEO1, VIDEO2, and VIDEO3 by the distributing switch unit 13 in FIG. 6 are illustrated in respective states of connection of the distributing switch unit 13.

TABLE 3

| State | VIDEO1 | VEDEO2 | VIDEO3 |
|---|---|---|---|
| (1) | B signal | R signal | G signal |
| (2) | G signal | B signal | R signal |
| (3) | R signal | G signal | B signal |

As is evident from Tables 3 and 2, similarly to a case that the construction in FIG. 7 is adopted, data signal currents of desired colors are supplied to the data lines of RGB columns in all the selected states of the distributing switch units 34 and 13. FIG. 10 is a table showing the voltage-current conversion factor corresponding to each pixel according to the voltage-current conversion characteristics of the column current generation circuits which are expressed in Formulas 1 and 2.

The figures in the left end of FIG. 10 are the connection states of the distributing switch units 34 and 13, and repeat "(1)→(2)→(3)" in each row. A current of each column is generated by changing the voltage-current conversion circuits with the drive factors A1, B2, A3, B1, A2, and B3 in the column drive circuits one by one. Therefore, even if dispersion exists among the drive factors A1, B2, A3, B1, A2, and B3 as is evident from FIG. 10, it is dispersed in a cycle of six lines. In addition, a data signal current which is supplied to each color column is based on an analog video signal which is derived from the same digital-to-analog converter DAC.

Therefore, the display non-uniformity of the fixed pattern in every three lines which is caused by the gain dispersion among the DAC1, DAC2, and DAC3 is not generated.

Surely, although white balance shifts by the gain dispersion among the DAC1, DAC2, and DAC3, the white balance can be easily adjusted by a widely known method by digital processing in the DSP 12.

Hence, when the signal processing circuit 32 in FIG. 6 is used, the dispersion among the drive factors A1, B2, A3, B1, A2, and B3 of the voltage-current conversion circuits illustrated in FIG. 4 can be dispersed effectively so that it may not appear as much as possible in display image quality.

Embodiment 2

Figure 11:
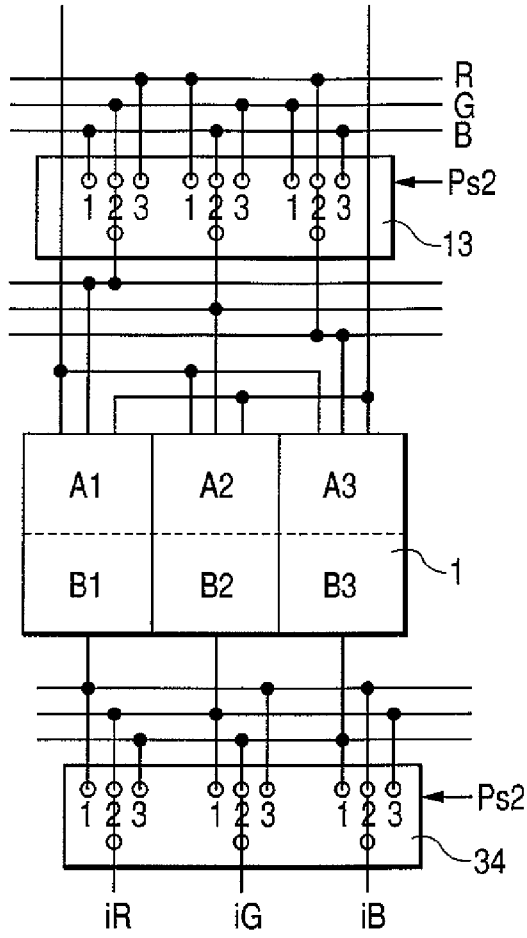
FIG. 11 is a schematic diagram for explaining a peripheral circuit including a column drive circuit, and first and second dispersion circuits according to a second embodiment of the present invention.
Figure 12:
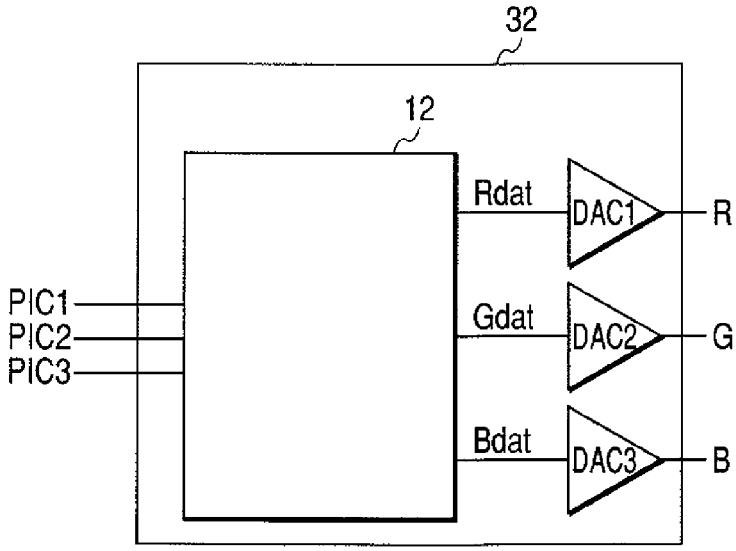
FIG. 12 is a schematic diagram for explaining a signal processing circuit.

FIGS. 11 and 12 illustrate first and second dispersion circuits, and column drive circuits and a signal processing circuit, which are used in another embodiment.

Without providing a first dispersion circuit, on a substrate which has the same insulating surface as that of a display unit, the first dispersion circuit 13 is provided in the signal processing circuit in FIG. 12 with being integrated with the column drive circuits and the second dispersion circuit. Every transistor in these circuits is constructed of a TFT which uses a non-monocrystalline semiconductor, such as a polysilicon, for an active layer.

As illustrated in FIG. 12, an R signal, a G signal, and a B signal are respectively output in parallel from the DSP 12 through the DAC1, DAC2, and DAC3. The distributing switch unit 13 is integrated with the column drive circuits and the second dispersion circuit 34, as illustrated in FIG. 11. In FIG. 12, only the DSP 12 and the digital-to-analog converters are integrated on a monocrystalline semiconductor substrate to become a one-chip LSI.

As illustrated in FIG. 11, connection states of the analog video signals RGB for each color are changed every horizontal scanning by the distributing switch unit 13 which is the first dispersion circuit, and, the column drive circuits of output destinations are changed. Nevertheless, by the second selecting switch 34, since the output destinations of the data signal currents from the column drive circuits are changed, the data signal currents for each color are supplied to data lines (iR, iG, and iB) of corresponding colors.

These first and second dispersion circuits are controlled by the control lines Ps1 and Ps2.

As is evident from Tables 3 and 2, similarly to the first embodiment, data signal currents of desired colors are supplied to the data lines of RGB columns in all the selected states of the distributing switch units 34 and 13.

As illustrated in FIG. 10, distribution states of the voltage current conversion factors to respective pixels are the same.

Since the distributing switch unit 13 can be arranged over full width of horizontal size of a display screen on a display panel, dispersion among conductive resistances of respective switches in the distributing switch unit 13 can be suppressed as much as possible. Then, it can be performed to balance a sampling operation affected by a sampling time constant in each column drive circuit.

In addition, although one switch for dispersion is provided to one row of data line in FIG. 11, it is also suitable to provide one switch to a plurality of data line groups. In this way, parasitic capacitance of each analog video signal line matrix wiring unit of RGB can be reduced by making the number of the switches of the first dispersion circuit the number smaller than the number of columns. In addition, it can be also performed to reduce parasitic capacitance in the matrix wiring unit between the dispersion circuit 13 and the column drive circuit 1. Furthermore, it can be also performed to suppress increase in parasitic capacitance generated by wiring intersection of gates of the switching unit 13 itself. In this way, the sampling time constant can be suppressed and the balance of the sampling operation becomes good.

Furthermore, it is needless to say that it can be also performed to prevent the dispersion among the drive factors A1, B2, A3, B1, A2, and B3 of the voltage-current conversion circuits from appearing as much as possible in display image quality similarly to the first embodiment.

This application claims the benefit of Japanese Patent Application No. 2006-097998, filed Mar. 31, 2006 which is hereby incorporated by reference herein in its entirety.

The invention claimed is:

1. A color display apparatus comprising:

a display unit comprising electro-optical elements emitting a plurality of colors, the electro-optical elements arranged in a row direction and a column direction, scanning lines provided in respective rows of the electro-optical elements to select respective rows, and data lines provided in respective columns and supplying data signals to electro-optical elements in the row which the scanning lines select;

conversion circuits, each of which receives a digital video signal and converts the digital video signal to an analog video signal, with a conversion circuit provided for each color of the color display apparatus;

a first dispersion circuit for receiving the analog video signals outputted from the conversion circuits and exchanging an arrangement of the analog video signals to output to bus lines;

column drive circuits which sample the analog video signals in the bus lines in a time sharing manner, and generate and output the data signals; and a second dispersion circuit for receiving the data signals outputted from the column drive circuits and exchanging an arrangement of the data signals to output to the data lines, wherein the exchanging of the data signals by the second dispersion circuit restores the exchanging of the arrangement by the first dispersion circuit so that the analog video signal for each color of the color display apparatus is output to the data line corresponding to that color.

2. The color display apparatus according to claim 1, wherein the first dispersion circuit is an integrated circuit of a monocrystalline semiconductor, and the second dispersion circuit is an integrated circuit of a non-monocrystalline semiconductor.

3. The color display apparatus according to claim 1, wherein the first dispersion circuit and the second dispersion circuit are integrated circuits of non-monocrystalline semiconductors.

4. The color display apparatus according to claim 1, wherein the second dispersion circuit and the column drive circuits are integrated circuits of non-monocrystalline semiconductors.

5. The color display apparatus according to claim 1, wherein switching of the first and second dispersion circuits is performed synchronously with row selection of the scanning lines.

6. The color display apparatus according to claim 1, wherein the conversion circuits are digital-to-analog converters or analog amplifiers.

* * * * *